US006485679B1

(12) United States Patent
Sundström et al.

(10) Patent No.: US 6,485,679 B1
(45) Date of Patent: Nov. 26, 2002

(54) HEAT RESISTANT AUSTENITIC STAINLESS STEEL

(75) Inventors: Ann Sundström, Sandviken (SE); Goucai Chai, Sandviken (SE)

(73) Assignee: Sandvik AB, Sandviken (SE)

( * ) Notice: Subject to any disclaimer, the term of this patent is extended or adjusted under 35 U.S.C. 154(b) by 0 days.

(21) Appl. No.: 09/505,175

(22) Filed: Feb. 16, 2000

(30) Foreign Application Priority Data

Feb. 16, 1999 (SE) ..... 9900555

(51) Int. Cl.[7] ..... C22C 38/42; C22C 38/44; C22C 38/48; C22C 28/00

(52) U.S. Cl. ..... 420/38; 420/39; 420/49; 420/53; 420/54; 420/584.1; 420/585; 420/586; 420/586.1

(58) Field of Search ..... 420/49, 54, 53, 420/38, 39, 584.1, 585, 586, 586.1, 327

(56) References Cited

U.S. PATENT DOCUMENTS 4,981,647 A * 1/1991 Rothman et al. ..... 420/586.1

FOREIGN PATENT DOCUMENTS

| | | | |
|---|---|---|---|
| JP | 362133048 A | * | 6/1987 |
| JP | 64-11950 | | 1/1989 |
| JP | 7-138708 | | 5/1995 |

* cited by examiner

*Primary Examiner*—Deborah Yee
(74) *Attorney, Agent, or Firm*—Burns, Doane, Swecker & Mathis, L.L.P.

(57) ABSTRACT

A heat resistant austenitic stainless steel with high strength at elevated temperatures, good steam oxidation resistance, good fire side corrosion resistance, and a sufficient structural stability, suitable for use in boilers operating at high temperatures has a composition (by weight) of. 0.04 to 0.10% carbon (C), not more than 0.4% silicon (Si), not more than 0.6% manganese (MN), 20 to 27% chromium (Cr), 22.5 to 32% nickel (Ni), not more than 0.5% molybdenum (Mo), 0,20 to 0.60% niobium (Nb), 0.4 to 4.0% tungsten (W), 0.10 to 0.30% nitrogen (N), 0.002 to 0.008% boron (B), less than 0.05% aluminium (Al), at least one of the elements Mg and Ca in amounts less than 0.010% Mg and less than 0.010% Ca, and the balance being iron and inevitable impuities.

9 Claims, No Drawings

HEAT RESISTANT AUSTENITIC STAINLESS STEEL

FIELD OF THE INVENTION

The object of this invention is to provide a heat resistant austenitic stainless steel with high strength at elevated temperatures, good steam oxidation resistance, good fire side corrosion resistazce and a sufficient structural stability.

This invention also relates to a structural member of a boiler made of such heat resistant austenitic stainless steel with high strength at elevated temperatures, good steam oxidation resistance, good fire side corrosion resistance, and sufficient structural stability. Such a structural member could for instance be in the shape of an extruded seamless tube.

BACKGROUND OF THE INVENTION

Austenitic stainless steels have been widely used for example as superheater and reheater tubes in power plants. In order to increase efficiency and meet environmental requirements, power plants will be required to operate at higher temperatures and under higher pressures. As a result, the material used in this type of installations requires improved properties regarding creep strength and corrosion resistance, since the conventional austenitic stainless steels such as AISI 347, AMSI 316 and AISI 310 will not be able to meet these higher demands. Various development efforts have been and are being performed in order to meet these tendencies towards more severe operation conditions in the power plant.

In general the precipitation of carbonides and solid solution hardering through addition of molybdenum and tungsten is effective for improving the strength of austenitic stainless steels at elevated temperatures. In addition there have also been improvements of the strength by adding considerable amount of copper to austenitic stainless steel. Chromium is the essential element used for improving the oxidation and corrosion resistance in high temperature alloys. Furthermore, the nickel content required for ensuring a structurally stable austenitic structure has been reduced in some previously developed alloys, due to substituting with nitrogen.

Generally it is difficult to obtain a corrosion resistant material with a high creep rupture strength that also has an acceptable structural stability, even when nitrogen is added as substitute for some of the expensive nickel. A rather high amount of nickel is needed in this material, with high levels of ferrite forming elements such as chromium, tungsten and niobium in order to suppress the formation of brittle phases such as the sigma phase after long term exposure. Chromium is added for big corrosion resistance and tungsten and niobium for high creep rupture strength. Other sigma phase promoting elements such as silicon and molybdenum have been held low while some elements, other than nickel have been added for the purpose of improving the structural stability.

SUMMARY OF INVENTION

The present invention provides an alloy with high creep rupture strength at elevated temperatures for long periods of time, a good steam oxidation resistance and fire side corrosion resistance and a sufficient structural stability.

An austenitic stainless steel according to the present invention comprises (by weight) 0.04 to 0.10% carbon (C), not more than 0.4% silicon (Si), not more than 0.6% manganese (Mn), 20 to 27% chromium (Cr), 22.5 to 32% nickel (Ni), not more than 0.5% molybdenum (Mo), 0.20 to 0.60% niobium b), 0.4 to 4.0% tungsten (W), 0.10 to 0.30% nitrogen (N), 0.002 to 0.008% boron (B), less than 0.05% aluminium (Al), at least one of the elements magnesium (g) and calcium (Ca) in amounts less than 0.010% Mg and less than 0.010% Ca, the balance being iron and inevitable impurities. Optionally, 2.0–3.5% copper (Cu) and/or 0.5% to 3% cobalt (Co) and/or 0.02–0.1% titanium (Ti) could be included.

In one embodiment of the present invention, the austenitic stainless steel has a composition that consists essentially of the above-listed constituent elements.

In further embodiment of the present invention, the austenitic stainless steel has a composition that consists of the above-listed constituent elements.

DETAILED DESCRIPTION OF THE INVENTION

The constituent elements of an alloy formed according to one prefered embodiment of he present invention are discussed below. The listed percentages are by weight.

Carbon

Carbon is a component effective to provide adequate tensile strength and creep rapture strength required for high temperature steel. However, if excess carbon is added, the toughness of the alloy is reduced and the weldability may be deteriorated. For these reasons, the carbon content is defined by a range of 0.04% to 0.10%, preferably 0.06–0.08%

Silicon

Silicon is effective as a deoxidizing agent and it also serves to improve oxidation resistance. However, an excess of silicon is detrimental to the weldability and in order to prevent the deterioration of ductility and toughness due to the formation of sigma phase after long term exposure to an environment encountered in power plants, the silicon content should not be more than 0.4%, preferably much lower than 0.2%.

Manganese

Manganese is a deoxidizing element and is also effective to improve the hot workability. However, in order to prevent the creep rupture strength, ductility and toughness from decreasing, the manganese content should not be more than 0.6%.

Phosphorous and Sulphur

Phosphorous and sulphur are detrimental to the weldability and may promote embrittlement. Therefore, the phosphorus and sulphur content should not exceed 0.03% or 0.005%, respectively.

Chromium

Chromium is an effective element to improve the fire side corrosion resistance and steam oxidation resistance. In order to achieve a sufficient resistance in that regard, a chromium content of at least 20% is needed. However, if the chromium content exceeds 27%, the nickel content must be further increased in order to produce a stable austentitic structure and suppress the formation of the sigma phase after long periods of time at elevated temperatures. In view of the considerations, the chromium content is restricted to a range of 20% to 27%, preferably 22–25%.

Nickel

Nickel is an essential component for the purpose of ensuring a stable austenitic structure. The structural stability depends essentially on the relative amounts of the ferrite stabilizers such as chromium, silicon, molybdenum, aluminium, tungsten, titanium and niobium, and the austenite stabilizers such as nickel, carbon and nitrogen. In order to suppress the formation of sigma phase after long periods of time at elevated temperatures, particularly at the high chromium, tungsten and niobium content needed to ensure high temperature corrosion resistance and high creep rupture strength, the nickel content should be at least 22.5%, preferably higher than 25%. In addition, at a specific chromium level, an increased nickel content suppresses the oxide growth rate and increases the tendency to form a continuous chromium oxide layer. However, in order to maintain the production cost at a reasonable level, the nickel content should not exceed 32%. In view of the above circumstances, the nickel content is restricted to a range of 22.5% to 32%.

Tungsten and Molybdenum

Tungsten is added to improve the high temperature strength mainly through solid solution hardening and a minimum of 0.4% is needed to achieve this effect. However, both molybdenum and tungsten promote the formation of the sigma phase, and may also accelerate the fire side corrosion. Tungsten is considered to be more effective than molybdenum in improving the strength. For these reasons, the molybdenum content is held low, not more than 0.5%, preferably lower than 0.02%. However, in order to maintain a sufficient workability the tungsten content should not exceed 4.0% and therefore the tungsten content is restricted to a range of 0.4% to 4.0%, preferably 1.8% to 3.5%.

Cobalt

Cobalt is an austenite-stabilizing element. The addition of cobalt may improve the high temperature strength through solid solution strengthening and suppression of sigma phase formation after long exposure times at elevated temperatures. However, in order to maintain the production cost at a reasonable level, the cobalt content should be in the range 0.5% to 3.0% if added.

Titanium

Titanium may be added for the purpose of improving the creep rupture strength through the precipitation of carbonitrides, carbides and nitrides. However, an excessive amount of titanium can decrease the weldability and the workability. For these reasons, the content of titanium is defined to a range of 0.02% to 0.10% if added.

Copper

Copper may be added in order to produce copper rich phase, finely and uniformly precipitated in the matrix, which may contribute to an improvement of the creep rupture stength. However, an excessive amount of copper results in a decreased workability. In view of these considerations, the copper content is defined to a range of 2.0% to 3.5%

Aluminium and Magnesium

Aluminium and magnesium are effective for deoxidization during manufacturing. However, an excessive amount of alumimum may accelerate the precipitation of the sigma phase and an excessive amount of magnesium may deteriorate the weldability. For these reasons, the content of aluminium is selected to be at least 0.003% but not more than 0.05%, and the content of magnesium is selected to be less than 0.01%.

Calcium

Calcium is effective for deoxidization during manufacturing. The calcium content is selected to be not more than 0.01%, if added.

Niobium

Niobium is generally accepted to contribute to improving the creep rupture strength through the precipitation of carbonitrides and nitrides. However, an excessive amount of niobium can decrease the weldability and the workability. In view of these considerations the niobium content is restricted to a range of 0.20% to 0.60%, preferably 0.33 to 0.50%.

Boron

Boron contributes to improve the creep rupture strength partly due to the formation of finely dispersed $M_{23}(C,B)_6$ and the strengthening of the grain boundary. Boron may also contribute to improve the hot workability. However, an excessive amount of boron may deteriorate the weldability. In view of these considerations, the boron content is restricted to a range of 0.002% to 0.008%.

Nitrogen

Nitrogen, as well as carbon, is known to improve the elevated temperature strength, the creep rupture strength and to stabilize the austenite phase. However, if nitrogen is added in excess, the toughness and ductility of the alloy is reduced. For these reasons, the content of nitrogen is defined to a range of 0.10% to 0.30%, preferably 0.20–0.25%

Exemplary Method of Making an Article Comprising the Alloy of the Present Invention:

In making an alloy of the present invention, a melt of the alloy may be prepared by any conventional processes, including electric arc furnaces, argon-oxygen-decarburization (AOD), and vacuum induction melting processes. The melt can then be continuously cast into blooms, or cast into ingots, rolled and/or forged and then made into seamless tubes by hot extrusion. The steel can then be cold pilgered and/or drawn and subjected to solution treatment at elevated temperatures, such as 1150–1250° C. Such tubes can advantageously be used as components of superheaters.

In order to more completely understand the present invention, the following examples are presented.

EXAMPLE

Table 1 shows the chemical composition of some alloys of this invention prepared in laboratory high frequency furnaces. Test specimens from all of these alloys were prepared and subjected to a creep rupture test at 700° C. Table 2 shows the result of the creep rupture test as the creep rupture time at 185 MPa and at 165 MPa.

The high nickel alloy with a combination of high nitrogen, niobium, tungsten, cobalt and copper contents shows the best creep properties (Alloy No. 605105). Furthermore, a high nitrogen level is essential for the creep rupture strength (Alloy Nos. 605105, 605107 and 605112). Alloys with a combination of high levels of tungsten and cobalt possesses a better creep performance. A comparison of the high level nickel and nitrogen alloys (Alloy Nos. 605105 and 605107) reveals that the alloy with higher level of tungsten and cobalt is performing better. Furthermore, a high level of cobalt may contribute to better creep properties. A comparison of the high tungsten alloys (Alloys Nos. 605108 and 605113), shows that the alloy with the higher level of cobalt possesses the better creep strength.

Table 3 shows the chemical composition of some alloys of this invention prepared as laboratory melts using vacuum induction melting process which enables achieving a higher purity degree of the alloy. This Table 3 also shows the results of the creep rupture test at 700° C. as the creep rupture time (in hours) at 165 MPa and at 140 MPa. These tests are still running, but results so far appear in the table.

TABLE 1

| Heat No. | C | Si | Mn | Cr | Ni | W | Co | Cu | Nb | B (ppm) | N |
|---|---|---|---|---|---|---|---|---|---|---|---|
| | Chemical composition [wt.-%]. The balance being Fe and impurities | | | | | | | | | | |
| 605119 | 0.072 | 0.09 | 0.52 | 22.8 | 24.9 | 2.00 | 0.99 | | 0.42 | 31 | 0.14 |
| 605099 | 0.074 | 0.07 | 0.54 | 23.1 | 25.1 | 1.06 | 0.03 | | 0.41 | 30 | 0.16 |
| 605100 | 0.074 | 0.04 | 0.49 | 25.1 | 24.9 | 1.02 | 1.03 | | 0.41 | 27 | 0.16 |
| 605101 | 0.074 | 0.04 | 0.48 | 25.1 | 24.9 | 1.99 | 0.06 | | 0.42 | 27 | 0.16 |
| 605104 | 0.072 | 0.06 | 0.50 | 24.1 | 24.8 | 1.51 | 0.49 | | 0.41 | 28 | 0.15 |
| 605105 | 0.076 | 0.07 | 0.22 | 24.6 | 26.3 | 1.90 | 1.50 | 2.5 | 0.49 | 29 | 0.24 |
| 605107 | 0.076 | 0.10 | 0.25 | 24.2 | 27.1 | 0.60 | 0.03 | 2.4 | 0.48 | 29 | 0.26 |
| 605108 | 0.076 | 0.08 | 0.22 | 24.3 | 26.4 | 2.00 | 0.02 | 2.4 | 0.49 | 30 | 0.15 |
| 605112 | 0.078 | 0.09 | 0.22 | 24.5 | 26.3 | 0.54 | 1.50 | 2.5 | 0.42 | 30 | 0.22 |
| 605113 | 0.076 | 0.07 | 0.22 | 24.4 | 26.3 | 2.00 | 1.40 | 2.4 | 0.43 | 32 | 0.15 |

TABLE 2

| Heat No. | 185 MPa Rupture time [h] | 165 MPa Rupture time [h] |
|---|---|---|
| | Creep rupture time at 700° C. | |
| 605119 | 643 | 1085 |
| 605099 | 472 | 665 |
| 605100 | 606 | 982 |
| 605101 | 758 | 1103 |
| 605104 | 565 | 1052 |
| 605105 | 1024 | 1631 |
| 605107 | 771 | 1306 |
| 605108 | 454 | 760 |
| 605112 | 657 | 1170 |
| 605113 | 479 | 884 |

not more than 0.4% silicon;

not more than 0.6% manganese;

20 to 27% chromium;

22 to 32% nickel;

not more than 0.5% molybdenum;

0.20 to 0.60% niobium;

0.4 to 4.0% tungsten;

0.10 to 0.30% nitrogen;

0.002 to 0.008% boron;

0.003 to 0.05% aluminum;

2–3.5% Cu;

0.5–3% Co;

at least one of magnesium and calcium in an amount less than 0.010%; and the balance iron and normal steel-making impurities.

TABLE 3

| Heat No. | | C | Si | Mn | Cr | Ni | W | Co | Ti | Cu | Nb | B [ppm] | N | 165 MPa Rupture time [h] | 140 MPa Rupture time [h] |
|---|---|---|---|---|---|---|---|---|---|---|---|---|---|---|---|
| | | Chemical composition of some of the alloys of this invention [wt-%] and creep rupture test results at 700° C. and 165 MPa and 140 MPa | | | | | | | | | | | | | |
| 830 202 | 1 | 0.075 | 0.20 | 0.50 | 23.9 | 26.6 | 2.2 | 0.0 | <0.005 | 3.0 | 0.33 | 40 | 0.22 | 1753 | >3252 |
| 830 159 | 2 | 0.079 | 0.23 | 0.51 | 22.6 | 25.1 | 3.5 | 0.0 | <0.005 | 3.0 | 0.34 | 37 | 0.22 | >2132 | >3228 |
| 830 161 | 3 | 0.079 | 0.27 | 0.52 | 22.5 | 25.0 | 2.2 | 0.0 | <0.005 | 3.0 | 0.42 | 39 | 0.21 | >2316 | >3180 |
| 830 191 | 4 | 0.076 | 0.19 | 0.52 | 24.0 | 26.5 | 2.2 | 1.5 | <0.005 | 3.0 | 0.47 | 44 | 0.23 | >2316 | >3180 |
| 820 186 | 5 | 0.076 | 0.20 | 0.47 | 22.6 | 25.1 | 2.2 | 0.0 | 0.042 | 0.0 | 0.34 | 46 | 0.21 | >2268 | >3104 |

Although the present invention has been described in connection with preferred embodiments thereof, it will be appreciated by those skilled in the art that additions, deletions, modifications, and substitutions not specifically described may be made without departing from the spirit and scope of the invention as defined in the appendend claims.

We claim:

1. An austenitic stainless steel alloy having high creep rupture strength at elevated temperatures over long periods of time, good steam oxidation resistance, good fire side corrosion resistance and sufficient structural stability, the alloy having a composition comprising, in wt. %:

0.04 to 0.10% carbon;

2. The alloy of claim 1, comprising 22–25% Cr.

3. The alloy of claim 1, comprising 25–28% Ni.

4. The alloy of claim 1, comprising 1.8–3.5% W.

5. The alloy of claim 1, comprising 0.33–0.50% Nb.

6. The alloy of claim 1, comprising 0.20–0.25% N.

7. A structural member of a boiler for use at elevated temperatures made from the alloy of claim 1.

8. A seamless tube for use in a boiler at elevated temperatures made from the alloy of claim 1.

9. The alloy of claim 1, wherein the alloy is Ti-free.

* * * * *